US005121763A

United States Patent [19]

Kingsford

[11] Patent Number: 5,121,763

[45] Date of Patent: Jun. 16, 1992

[54] COSMETIC APPLICATION DEVICE HAVING A VARIABLE LENGTH COSMETIC APPLICATOR

[75] Inventor: Ted Kingsford, Sarasota, Fla.

[73] Assignee: Maybe Holding Company, Wilmington, Del.

[21] Appl. No.: 625,799

[22] Filed: Dec. 11, 1990

Related U.S. Application Data

[63] Continuation of Ser. No. 238,409, Feb. 26, 1981, abandoned.

[51] Int. Cl.[5] ..... A45D 40/24

[52] U.S. Cl. ..... 132/317; 401/122; 401/129

[58] Field of Search ..... 401/122, 116, 124, 125, 401/126, 127, 121, 129; 132/317

[56] References Cited

U.S. PATENT DOCUMENTS

| | | | |
|---|---|---|---|
| 790,582 | 5/1905 | Low | 401/127 |
| 835,955 | 11/1906 | Kuter | 401/127 |
| 2,195,472 | 4/1940 | Szves et al. | 132/79 C |
| 2,274,311 | 2/1942 | Wiehn | 132/79 C |
| 2,695,028 | 11/1954 | Dulberg | 132/79 C |
| 2,945,252 | 4/1961 | Martineau, Jr. | 401/116 |
| 3,209,730 | 10/1968 | Aston | 132/79 C |
| 3,529,899 | 9/1970 | Gruska | 401/121 |
| 3,692,417 | 9/1972 | Aston | 401/122 |
| 3,694,096 | 9/1972 | Seidler | 401/127 |
| 3,768,915 | 10/1973 | Spatz | 401/127 |
| 3,861,810 | 1/1975 | Vasas | 401/122 |
| 3,870,186 | 3/1975 | Reinhard | 401/122 |
| 4,241,743 | 12/1980 | Schnabel et al. | 401/122 |

*Primary Examiner*—Cary E. O'Conner
*Attorney, Agent, or Firm*—David J. Mugford

[57] ABSTRACT

A cosmetic application device having a applicator and cover means adapted to selectively vary the length of the applicator. The application device may be used for various cosmetics, including mascara, lipstick, eye liner, eye shadow, foundation, and blusher.

9 Claims, 2 Drawing Sheets

COSMETIC APPLICATION DEVICE HAVING A VARIABLE LENGTH COSMETIC APPLICATOR

This application is a continuation of application Ser. No. 07/238,409 filed Feb. 26, 1981, now abandoned.

This invention relates to an adjustable cosmetic application device, especially for applying mascara, having a variable length applicator. The invention, which can be manufactured without high expense, has several advantages. For example, each individual user can find the setting that she prefers and retain that setting. Some users may prefer brushes of different lengths for different purposes. A long brush may be desired for applying mascara to the upper lashes, but a short brush may be better suited for the lower lashes. This invention achieves different brush lengths with one device.

Most prior-art cosmetic application devices do not have any means for making adjustments to suit the individual user.

An exception is U.S. Pat. No. 3,998,235, which discloses a mascara application device that allows adjustment of the axial distance between the applicator's coating surfaces in order to vary the amount of mascara held by the applicator spring. However the incidental change of length of the spring can not be accomplished without varying its characteristics. When this prior-art device is adjusted to a long position, the amount of cosmetic held per unit of spring length is increased, and vice versa. This is not always desirable, since a user may prefer a long applicator with a small concentration of cosmetic held thereon. The present invention allows the user to adjust the length of the applicator without changing its characteristics.

The invention is best described with regard to the accompanying drawings of which:

DETAILED DESCRIPTION

Figure 1:
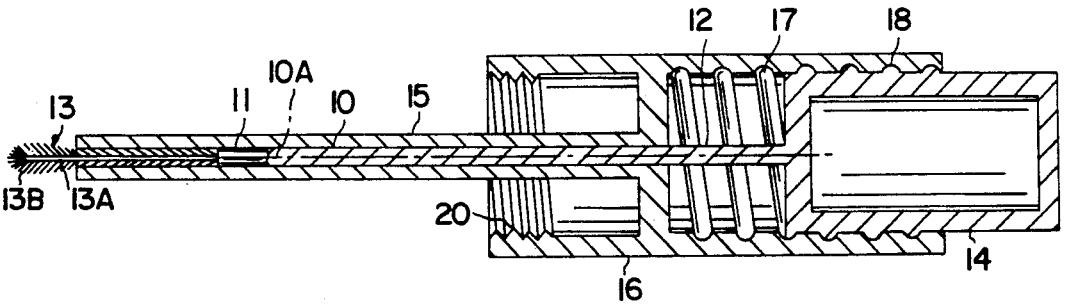
FIG. 1 is a longitudinal cross-sectional view of a cosmetic application device in accordance with the invention.

Referring to FIG. 1, a shaft 10 has a longitudinal axis 10A, a first end 11 and a second end 12. Attached to first end 11 is a cosmetic applicator 13, preferably a mascara brush, and more preferably a radial bristle mascara brush. As shown in FIG. 1, brush 13 comprises a central member 13A disposed along an extension of axis 10A and bristles 13B radiating from central member 13A. A full radial bristle brush (as shown in the figures) may be used. The full brush has bristles disposed radially 360° around the center line of the brush. Alternately, the bristles could be shaved from one side leaving a half round brush.

Exemplary radial bristle brushes are disclosed in U.S. Pat. Nos. 3,214,782, and 3,870,186. Alternatively the applicator could be a longitudinal bristle brush as disclosed in U.S. Pat. No. 3,883,254, a comb as disclosed in U.S. Pat. No. 3,763,870, a foam or sponge as in U.S. Pat. No. 3,908,675 or a cylinder having circumfrential grooves threads as in U.S. Pat. No. 3,363,635. All of these patents; which are listed to exemplify, but not limit, the types of applicators that may be used with the present invention; are incorporated herein by reference to the extent pertinent.

The applicator may be chosen according to the cosmetic to be applied, be it lipstick, eye liner, eye shadow, foundation, blusher, etc. The applicator may be shaped. For example, if the applicator is a sponge, the sponge could have a row of prongs protruding therefrom.

Regardless of the particular applicator chosen, the present invention provides cover means adapted to selectively vary the length of the applicator. Preferably a sleeve 15 is disposed around at least a portion of shaft 10 longitudinally movable with respect to shaft 10. In the embodiment illustrated, the sleeve and shaft should have circular transverse crosssections. Other embodiments may have non-circular transverse cross-sections.

Means for adjusting the relative longitudinal positions of shaft 10 and sleeve 15 are provided, such that as adjustment is made, varying amounts of applicator 13 are covered by sleeve 15 thereby selectively varying the length of the applicator. The adjusting means are capable of retaining a selected adjustment. That is, once adjustment is made, it will be retained without any action by the user, until further adjustment is desired and intentionally made.

It is preferable to provide a first member 14 attached to second end 12 of shaft 10 having an outer thread 18. A prefered second member 16 attached to sleeve 15 has mating inner thread 17. The mating inner and outer threads provide the adjusting means. As first member 14 and second member 16 are rotated with respect to each other, shaft 10 and sleeve 15 more longitudinally with respect to each other causing varying amounts of applicator 13 to be covered by sleeve 15. When a suitable adjustment has been made it will be retained while the device is used. The adjustment is retained until the user intentially rotates the two members with respect to each other once again to achieve a different adjustment.

A stop (not shown) may be provided to prevent the two members from disengaging each other after applicator 13 has been completely retracted within sleeve 15.

Of course other types of adjusting means are acceptable. For example, members 14 and 16 could be slidably attached to each other, and a set screw could be provided to retain the adjustment. If there were sufficient friction between the two members to retain the adjustment, than the set screw would not be necessary. The adjusting means could be a spring loaded clamp attached to sleeve 15 that clamps second end 12 of shaft 10. In that case first member 14 and second member 16 would not be necessary.

Figure 2:
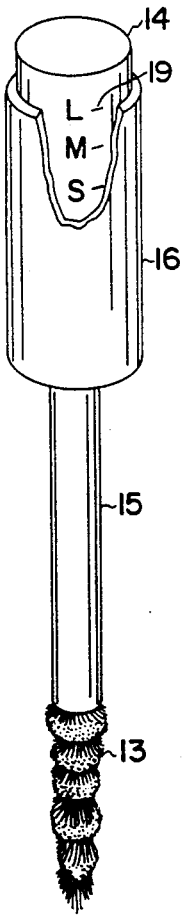
FIGS. 2, 3 and 4 are isometric views of the device of FIG. 1 showing the brush adjusted to various lengths.
Figure 3:
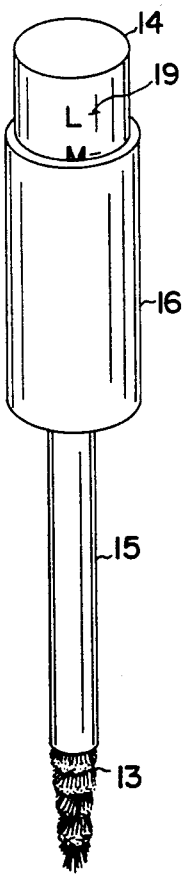
Figure 4:
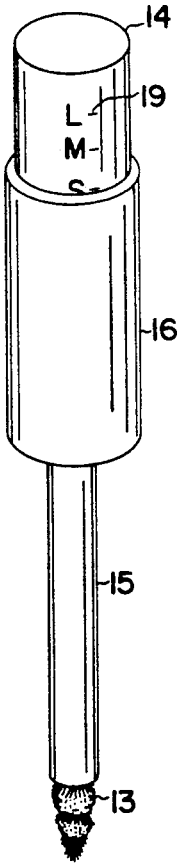

FIGS. 2, 3 and 4 show various adjustments of the device of FIG. 1. In FIG. 2 first member 14 and second member 16 have been rotated with respect to each other such that shaft 10 (not shown FIG. 2) has moved as far down relative to sleeve 15 as possible, thereby exposing the maximum amount of applicator 13.

In FIG. 3, first member 14 has been rotated with respect to second member 16 such that about ½ of brush 13 is exposed. In FIG. 4, first member 14 has been rotated such that only a minimum amount of brush 13 is exposed. Indicia 19 may be placed on first member 14 to indicate relative position. The indicia allow the user who requires more than one adjustment to conveniently restore suitable adjustments.

For greater flexibility it is preferable to adapt the adjusting means so that, at one adjustment, sleeve 15 completely covers applicator 13. The use of this adjustment will be explained shortly.

Figure 5:
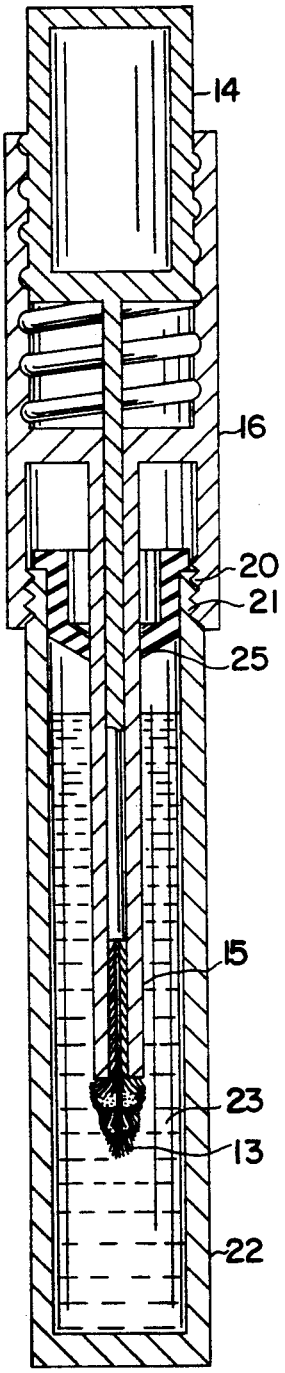
FIG. 5 is a longitudinal cross-section view showing the device of FIG. 1 attached to a bottle containing material to be applied.

The device is preferably adapted to act as a closure for a container of cosmetic material to be applied, with the applicator immersed in the cosmetic composition. This can be accomplished by inner thread 20 on second member 16 (see FIG. 1) which is adapted to attach the applicator to an externally threaded bottle neck. FIG. 5 shows the applicator attached to externally threaded neck 21 of bottle 22. With the applicator so attached, brush 13 is immersed in cosmetic composition 23 to be applied.

For some cosmetics, such as mascara, it is preferable to provide a wiper 25 positioned to wipe excess cosmetic from the applicator as the applicator is withdrawn from the container. Wiper 25 is preferably made of an elastomeric thermo-formed plastic material having a slight resiliency. A highly preferable embodiment would be an adjustable wiper as disclosed in U.S. Pat. No. 4,194,848 (the content of which is incorporated herein by reference) in combination with the adjustable-length applicator of the present invention. This combination would permit independent adjustment of both the length of the applicator (via the present invention) and the amount of cosmetic retained on the applicator per unit of length (via the adjustable wiper).

Figure 7:
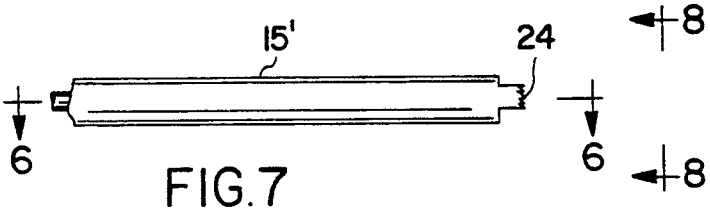
FIG. 7 is a top view of FIG. 6.
Figure 6:
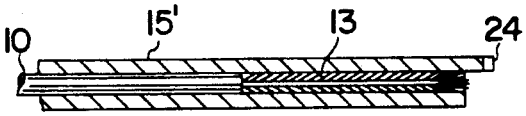
FIG. 6 is a longitudinal cross sectional view, taken along lines 6—6 of FIG. 7, of an alternate embodiment of the invention having a touch up tip at the end of a sleeve.
Figure 8:
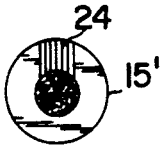
FIG. 8 is an end view of FIG. 7, taken along lines 8—8.

FIGS. 6, 7, and 8 illustrate an alternate embodiment of a sleeve. In these figures, sleeve 15' has a touch-up tip 24 at its end near brush 13. With the applicator adjusted so that brush 13 is completely covered by sleeve 15', touch-up tip 24 may be used for applying cosmetic to small areas, i.e., for touching up.

Still another embodiment contemplated is a small comb (not shown) disposed longitudinally along the shaft.

A preferred use of the cosmetic applicator of this invention is applying mascara. The invention enables the user to adjust the brush to a desired length for applying mascara to her particular lashes. In addition, users who want to use a different brush length for different areas, such as the upper lashes, lower lashes, eye brows, and so on may do so. The indicia allows the user to restore favorite adjustments.

In addition, the invention allows for even greater flexibility in applying cosmetics.

If the application means is a longitudinal bristle brush for applying lipstick, eyeliner, foundation or blusher, different adjustments will cause the longitudinal bristles to have varying degrees of stiffness. A shorter brush would be stiff because the shorter bristles would be less flexible. A longer brush would be soft, since the longer bristles would flex more. This would allow the user to select the most desirable degree of stiffness or softness best suited to her particular cosmetic and method of application.

Some mascara users like to comb and separate their lashes with a dry brush after the mascara has been applied. The present invention provides for this without the need to carry a separate brush. First, the user would apply mascara to her lashes with the invention using the desired length or lengths. Next, the applicator would be inserted into the bottle, and the brush retracted completely into the sleeve. If the sleeve were fairly tight fitting, it would scrape most of the mascara from the brush. Then the applicator would be withdrawn from the bottle and brush exposed to a desired length. The brush would now be fairly dry and could be used for combing and separating lashes. Little or no additional mascara would be applied.

Other modes of using the invention are contemplated. For example, the user might cover only part of the brush with mascara, withdraw the brush from the bottle, and then expose the entire brush. The portion of the brush containing mascara would be used as an applicator and the dry portion would be used as a dry comb. This would allow for faster yet more precise application of mascara, since the user would have a applicator holding mascara and a dry brush for combing and separating the lashes without applying unwanted mascara available in one handy tool. Thus the user would adjust the applicator so that it is partially covered by the shaft, as in FIG. 4, and dip the applicator into mascara. The user would then withdraw the brush from the bottle and adjust the length of the brush so that it is fully exposed as in FIG. 2. The lower part of the brush could be used to apply mascara, after which the upper half could comb and separate lashes without applying unwanted, extra mascara.

Still another mode of use could take advantage of the ability to cover the entire brush with mascara and then use the sleeve to push mascara forward onto the tip of the brush. This would attain a particularly heavy concentration of mascara on the tip of the brush, which many users find highly desirable. Thus the user would expose the entire brush as shown in FIG. 2 and dip it into mascara. Next the user would withdraw the brush from the bottle and adjust the brush as shown in FIG. 4. Sleeve 15 would push mascara forward into a heavy concentration on the part of the brush remaining exposed.

What is claimed is:

1. An applicator for the application of a pasty, liquid or semi-liquid cosmetic product comprising:

an elongate member having a product retaining portion comprising a central support stem a forward end of which carries a multiplicity of flexible, circumferentially spaced radial elements projecting laterally from said stem;

a cover member comprising a sleeve disposed over said elongate member;

wherein the cover member and the elongate member are relatively movable by manually operable means to selectively adjust the longitudinal positions of these members to more than two selected positions, said manually operable means comprising a handle having a first part with which one of said sleeve and elongate member is a one piece unit and a second part which is movable relative to the first part and with which said other of said sleeve and elongate member is a one piece unit, whereby, the length of the product retaining portion of said elongate member exposed for use in the application of said cosmetic product is selectively variable, and wherein said sleeve includes a forward end having an opening through which the stem can project, and which is smaller than the internal cross-sectional area of the sleeve so that as the flexible, circumferentially spaced radial elements enter the sleeve through said opening a radially inner part of said elements is wiped, and thereby cleaned by said opening.

2. An applicator according to claim 1 further comprising means coupling said second part to said fist part, said coupling means causing the relative movement between said sleeve and elongate member in response to the relative movement between said first and second parts.

3. An applicator according to claim 2 wherein said one of said sleeve and elongate member which is fixedly attached to said first part of the handle is said sleeve.

4. An applicator according to claim 2 wherein said handle is a closure cap adapted to be secured to the neck of a container for the cosmetic material with the sleeve and elongate member projecting into said container.

5. An applicator according to claim 1 wherein said flexible, circumferentially spaced radial elements of said product retaining portion are selected from the group comprising bristles and teeth and wherein said sleeve has a forward end opening which, when the sleeve moves forwardly or the elongate member moves rearwardly, engages behind said elements and causes them to flex to an axially forwardly projecting orientation to form an axial end brush projecting forwardly of said end of said stem.

6. An applicator according to claim 5 wherein said product retaining portion is a brush comprising a multiplicity of bristles.

7. An applicator according to claim 1 wherein the means to selectively adjust the product retaining portion of said elongate member to more than two selected positions is capable of retaining said product retaining portion in the selected position.

8. An applicator according to claim 7 wherein the means to selectively adjust the product retaining portion of said elongate member to its selected position contains indicia.

9. An applicator for the application of a pasty, liquid or semi-liquid cosmetic product comprising:

an elongate member having a product retaining portion comprising a central support stem a forward end of which carries a multiplicity of flexible, circumferentially spaced radial elements projecting laterally from said stem;

a cover member comprising a sleeve disposed over said elongate member;

wherein the cover member and the elongate member are relatively movable by manually operable means to selectively adjust the longitudinal positions of these members to more than two selected positions, said manually operable means comprising a handle having a first part with which one of said sleeve and elongate member is a one piece unit and a second part of which is movable relative to the first part and with which said other of said sleeve and elongate member is a one piece unit whereby the length of the product retaining portion of said elongate member exposed for use in the application of said cosmetic product is selectively variable, and wherein said cover member includes, on an outer surface thereof, surface formulations constituting a further product retaining portion which can be used for product retention and application.

* * * * *